US008770131B2

(12) United States Patent
Murray et al.

(10) Patent No.: US 8,770,131 B2
(45) Date of Patent: Jul. 8, 2014

(54) SPAR HULL CENTERWELL ARRANGEMENT

(75) Inventors: John James Murray, Houston, TX (US); Edmund Otto Muehlner, Houston, TX (US)

(73) Assignee: Floatec, LLC, Houston, TX (US)

( * ) Notice: Subject to any disclaimer, the term of this patent is extended or adjusted under 35 U.S.C. 154(b) by 50 days.

(21) Appl. No.: 13/052,585

(22) Filed: Mar. 21, 2011

(65) Prior Publication Data

US 2012/0125250 A1 May 24, 2012

Related U.S. Application Data

(60) Provisional application No. 61/417,064, filed on Nov. 24, 2010.

(51) Int. Cl.
*B63B 35/44* (2006.01)

(52) U.S. Cl.
USPC ..... 114/264

(58) Field of Classification Search
USPC ..... 114/264, 266, 267; 405/224.1–224.4, 405/195.1, 204, 205, 210, 211, 216, 224, 405/223.1; 166/345, 350, 355, 359, 367
See application file for complete search history.

(56) References Cited

U.S. PATENT DOCUMENTS

| | | | | |
|---|---|---|---|---|
| 3,771,481 | A | 11/1973 | Goren | |
| 4,606,673 | A * | 8/1986 | Daniell | 405/210 |
| 4,646,672 | A | 3/1987 | Bennett | |
| 4,702,321 | A * | 10/1987 | Horton | 166/350 |
| 6,488,447 | B1 * | 12/2002 | Nish et al. | 405/224.2 |
| 7,565,877 | B2 * | 7/2009 | Sablok et al. | 114/264 |
| 2004/0052586 | A1 * | 3/2004 | Horton, III | 405/223.1 |

OTHER PUBLICATIONS

U.S. Appl. No. 12/979,440, entitled Spar Hull Centerwell Arrangement, filed Apr. 28, 2011 by Murrary, et al.

* cited by examiner

*Primary Examiner* — Daniel V Venne
(74) *Attorney, Agent, or Firm* — Duane Morris LLP

(57) ABSTRACT

A floating spar hull for offshore oil and natural gas exploration and production having a centerwell arrangement wherein a supporting wellbay deck is positioned in the centerwell at a level below the uppermost portion of the spar hull in the centerwell. The wellbay deck is attached to the spar hull by any suitable means such as shear plates such that a space remains between the deck and the spar hull for risers. This allows equipment to be placed below the uppermost deck of the topsides and eliminates or minimizes wind loads on the equipment.

20 Claims, 7 Drawing Sheets

SPAR HULL CENTERWELL ARRANGEMENT

PRIORITY CLAIM

This application claims priority from Provisional Application Ser. No. 61/417,064 filed Nov. 24, 2010.

FIELD AND BACKGROUND OF INVENTION

The invention is generally related to floating offshore structures and more particularly to the centerwell arrangement of a spar type hull.

There are a number of spar hull designs available in the offshore drilling and production industry. These include the truss spar (FIG. 1C), classic spar (FIG. 1B), and cell spar (FIG. 1A). The term spar hull structure described herein refers to any floating structure platform, which those of ordinary skill in the offshore industry will understand as any floating production and/or drilling platform or vessel having an open centerwell configuration.

A spar hull is designed to support a topsides platform and riser system used to extract hydrocarbons from reservoirs beneath the seafloor. The topsides supports equipment to process the hydrocarbons for export to transport pipelines or to a transport tanker. The topsides can also support drilling equipment to drill and complete the wells penetrating the reservoir. The product from these wells is brought up to the production platform on the topsides by risers. The riser systems may be either flexible or steel catenary risers (SCR's) or top tensioned risers (TTR's) or a combination thereof.

The catenary risers may be attached at any point on the spar hull and routed to the production equipment on the topsides. The routing may be on the exterior of the hull or through the interior of the hull. The TTR's are generally routed from wellheads on the seafloor to the production equipment on the topsides platform through the open centerwell.

These TTR's may be used for either production risers to bring product up from the reservoir or as drilling risers to drill the wells and provide access to the reservoirs. In some designs where TTR's are used, either buoyancy cans or pneumatic-hydraulic tensioners can support (hold up) these risers. When buoyancy cans are used, the buoyancy to hold up the risers is supplied independently of the hull and when tensioners are used these tensioners are mounted on the spar hull and thus the buoyancy to hold up the risers is supplied by the spar hull. In either method of supporting the risers, TTR's are generally arranged in a matrix configuration inside an open centerwell. The spacing among the risers in this centerwell location is set to create a spacing among the risers that allows manual access to the production trees mounted on top of the risers.

The spar type structure which supports the topsides comprises a hard tank and other structural sections such as a truss and a soft tank or the hull can be completely enclosed as a cylinder. The hard tank supplies the majority of the buoyancy to support the hull structure, risers, and topsides platform. The hard tank is compartmentalized into a plurality of chambers among which the ballast can be shifted to control the hull's stability.

The open configuration in the center of the hard tank forms an open volume in the center of the hard tank referred to as the centerwell.

Since 1997, fifteen spar type structures have been constructed and installed. The spar type structures currently in operation are the cell spar, classic spar, and truss spar (shown in FIG. 1). The cell spar is constructed from a number of closed cylindrical cells to form the hull and supply most of the buoyancy. The classic and truss spar have a common component, typically referred to as the "hard tank", which supplies most of the buoyancy.

The primary advantage of the spar type structure is its low motions that minimize damage to riser and mooring systems and allow top tensioned risers with dry trees to be used for production. Topsides are supported on top of the spar using structural legs that adjust the height of the lower deck to avoid contact with waves. An open space in the center of the topsides, which is coaxial with the centerwell, is referred to as the wellbay (FIGS. 2, 3).

The riser arrangements are generally based on versions of catenary risers and top tensioned risers (TTR's). TTR's can be further categorized as production TTR and drilling riser TTR. The risers enter the spar topsides through the wellbay extending up from the centerwell. On all existing spar hulls the centerwell opening is square (FIGS. 2A, 3A, 4A, 6A, 7A). The size of the opening varies, depending on the number of risers coming up through the wellbay.

On conventional spars that have a drilling facility, the drilling rig and equipment are positioned on the top of the drilling deck above the open wellbay (FIG. 5A). The riser slots in the wellbay are arranged in a matrix configuration (FIG. 4A). The wells are drilled through these slots using the drilling riser. After the drilling phase of the well, the drilling rig is used to install or "run" the production TTR in the riser slot and connect it to the production manifold through the dry production tree and flexible jumper.

Subsequent to the initial installation of risers, there are interventions or "work-overs" into the oil and natural gas reservoir through the production TTR's for various reasons such as well stimulation and control. The drilling rig is also used for this operation. Consequently, drilling is suspended and the drilling rig is dedicated to work-over activities. The re-allocation of the drilling facilities causes a delay in drilling activity.

In order to access each well slot, the rig has to be positioned or "skidded" above the appropriate slot and therefore must be skidded in two horizontal directions as illustrated in FIG. 6A. Because of the weight of the drilling rig and the spans required to traverse the wellbay, the rig support structure is constructed of heavy structural beams, referred to as "skid beams".

In the traditional wellbay of currently operating spar type structures the risers/TTR's are positioned in a matrix format in the internal part of the wellbay (FIGS. 3A, 7A). At the top of these riser/TTR's is a dry tree which is connected to a manifold on the process equipment through a flexible jumper line. Fluids and gases from the reservoir flow up these risers/TTR's through the dry tree and flexible jumper connection and into the manifold. In the matrix layout, these jumpers sometimes cross over each other (FIG. 7A), which makes their design very difficult and in some cases limit the functionality of the design.

As mentioned above, all currently operating spar type structures equipped with drill rigs involve the installation of drilling equipment including its support structure and drill rig derrick mounted on top of the upper deck of the spar. This subjects the spar to large wind load areas at a high elevation and induces large overturning moments on the spar hull. In order to counteract these moments, heavy ballast is installed in the keel of the spar. This ballast must be supported by the buoyancy chambers in the spar, which increases the size of the spar hull.

Currently operating spar type structures using the matrix configuration completely utilize the wellbay and prevent this space from being used for other purposes.

SUMMARY OF INVENTION

The present invention addresses the shortcomings in the known art and is drawn to a floating spar hull centerwell arrangement for offshore exploration and production of oil and natural gas wherein a supporting wellbay deck is positioned in the centerwell at a level below the uppermost portion of the spar hull in the centerwell. The wellbay deck is attached to the spar hull by any suitable means such as shear plates such that a space remains between the deck and the spar hull for risers. This allows equipment to be placed below the uppermost deck of the topsides and eliminates or minimizes wind loads on the equipment.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

Figure 4B:
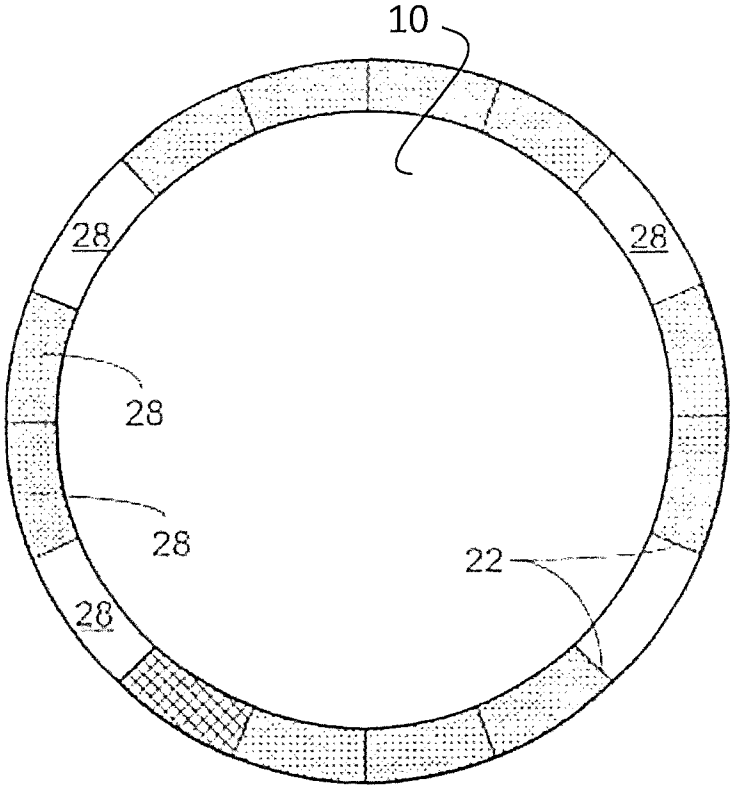
FIG. 4 illustrates a comparison of riser slot arrangement in the traditional spar wellbay with that of the invention.
Figure 5B:
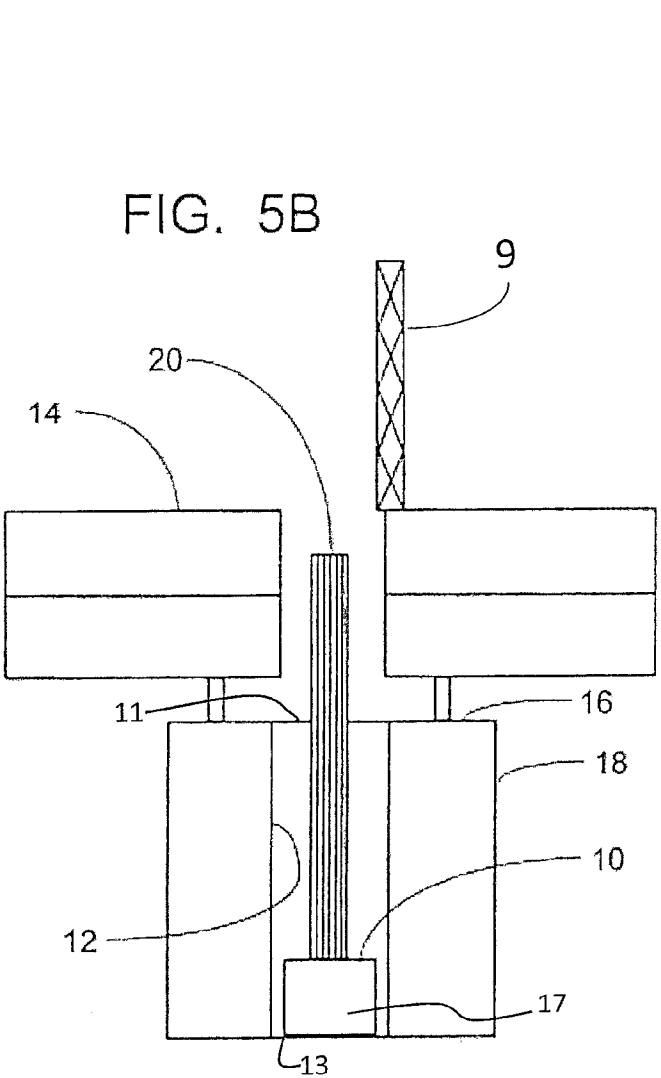
FIG. 5 illustrates a comparison of the drilling rig layout in the traditional spar wellbay arrangement with that of the invention.

FIG. 5B illustrates an embodiment of the invention which uses drilling rig 9 on topside 14, a deck 10 inside the centerwell 12, below the topsides 14 and the upper level 16 of the spar hull 18. The deck 10 is used to support a racking system 20 (illustrated) and any other suitable equipment. The deck 10 is rigidly attached to the spar hull 18 by any suitable means such as shear plates 22 best seen in FIGS. 3B and 4B to provide ample support for the racking system 20 and other equipment. The deck 10 is preferably a metal plate and sized smaller than the inner diameter of the spar hull 18 to define a space between the outer diameter of the deck 10 and the inner diameter of the spar hull 18 to receive equipment such as risers along the length of the centerwell 12. The centerwell 12 has an opening 11 at an upper portion and an opening 13 at a lower portion. The space below the waterline inside the centerwell 18 and below the deck 10 may be used for additional buoyancy devices 17.

While a deck 10 is illustrated as one embodiment of achieving the benefits of the inventive arrangement, it should be understood that additional means may also be used to achieve the same result and benefits. An example is an adjustable buoyancy centerwell device such as that described and illustrated in the application filed on Dec. 28, 2010 and assigned Ser. No. 12/979,440.

Figure 1C:
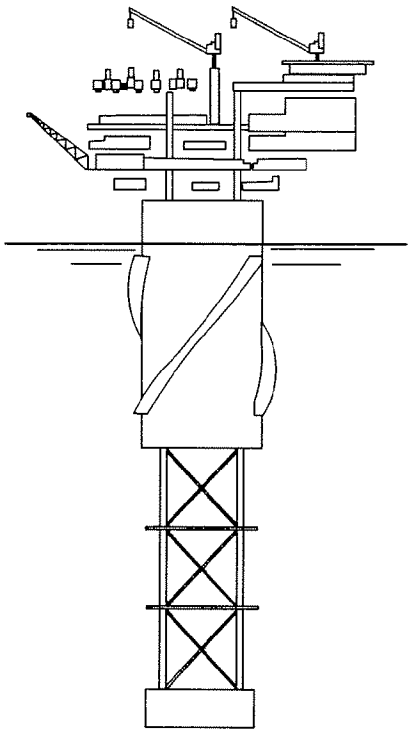
FIG. 1 illustrates the cell spar, classic spar, and truss spar structures.
Figure 1B:
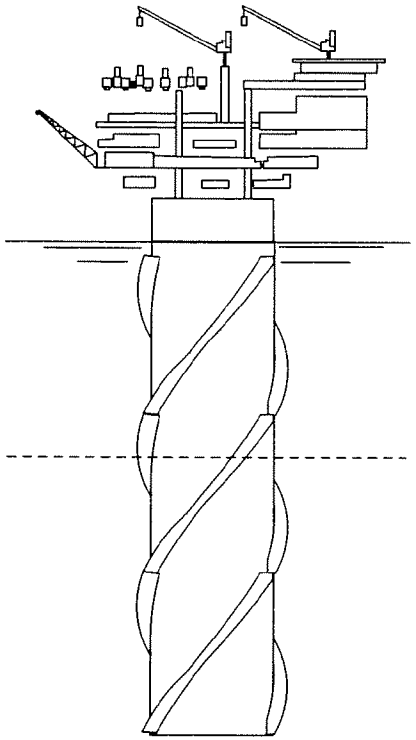
Figure 1A:
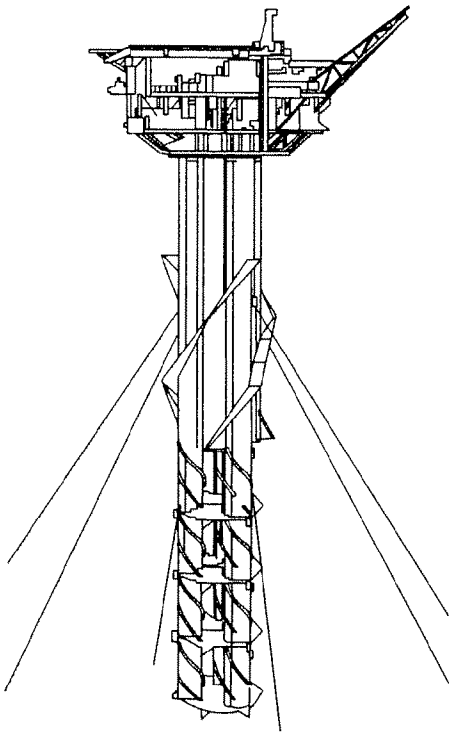
Figure 2A:
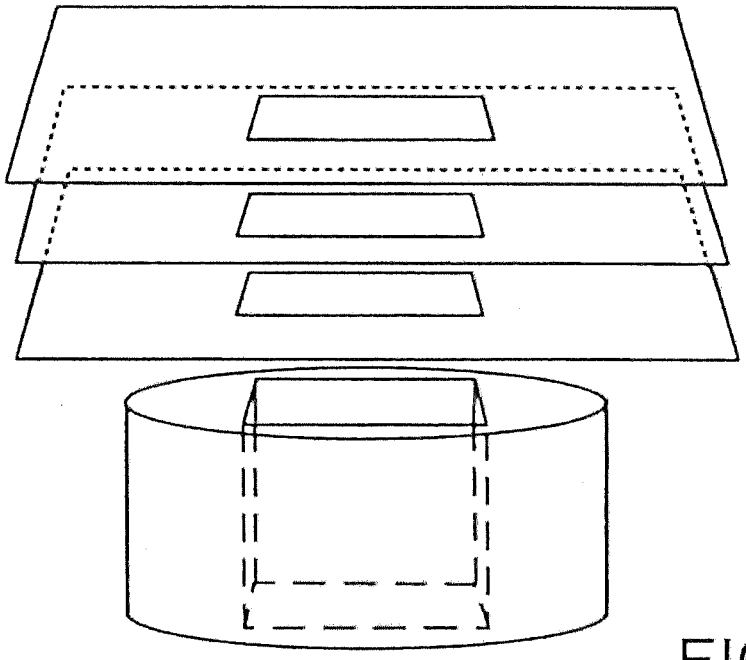
FIG. 2 illustrates a comparison of the traditional spar wellbay layout with one embodiment of the invention.
Figure 2B:
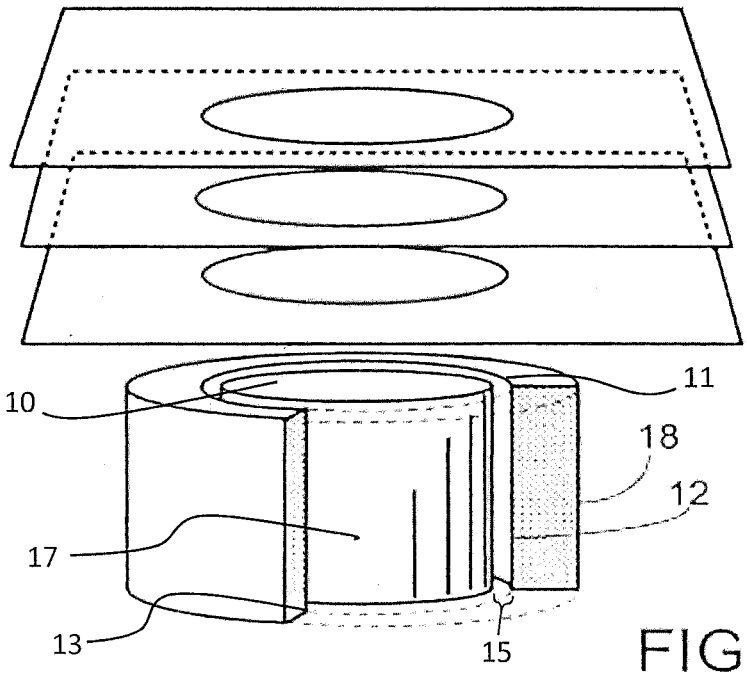
Figure 6B:
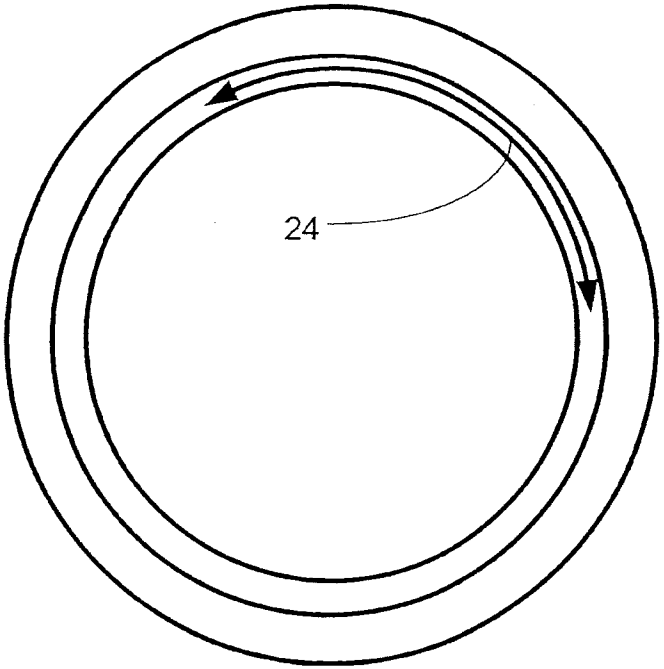
FIG. 6 illustrates a comparison of the skidding pattern in the traditional spar wellbay arrangement with that of the invention.

FIG. 2A illustrates the traditional wellbay layout in comparison with FIG. 2B, one embodiment of the invention. The inventive arrangement utilizes a circular centerwell 12 arrangement which openings 11, 13 at its upper and lower most portions which allows for a circular or radial skidding arrangement 24 on the upper deck of the topsides 14 as seen in FIGS. 5B, 6B. While a circular centerwell arrangement is illustrated, it should be understood that a rectangular or square centerwell arrangement may also be used with the invention. FIG. 2B also shows t he space 15 between the inter diameter of the centerwell 12 and the outer diameter of the deck 10. The space below the deck 10 may be used as an addition buoyancy device 17.

Figure 3A:
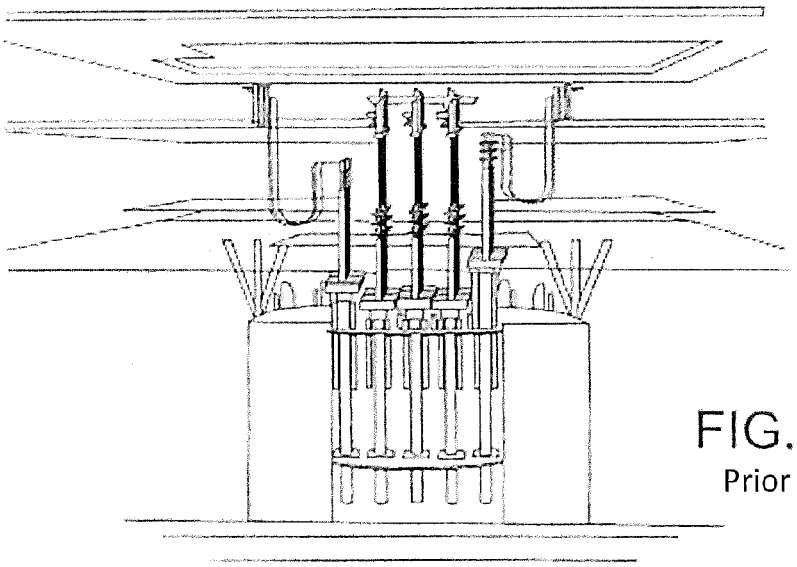
FIG. 3A Prior Art
FIG. 3 illustrates a comparison of riser arrangement in the traditional spar wellbay with that of the invention.
Figure 3B:
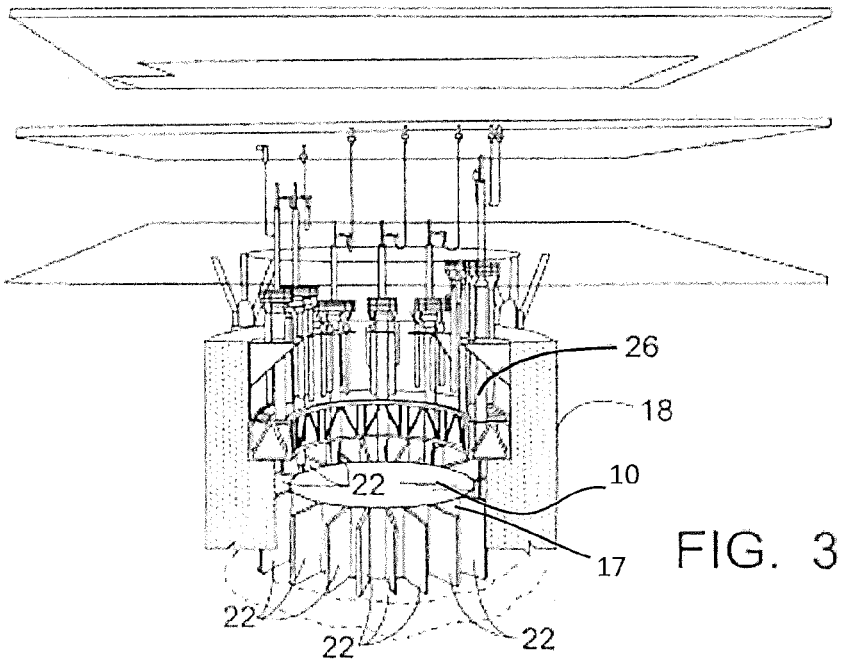
Figure 4A:
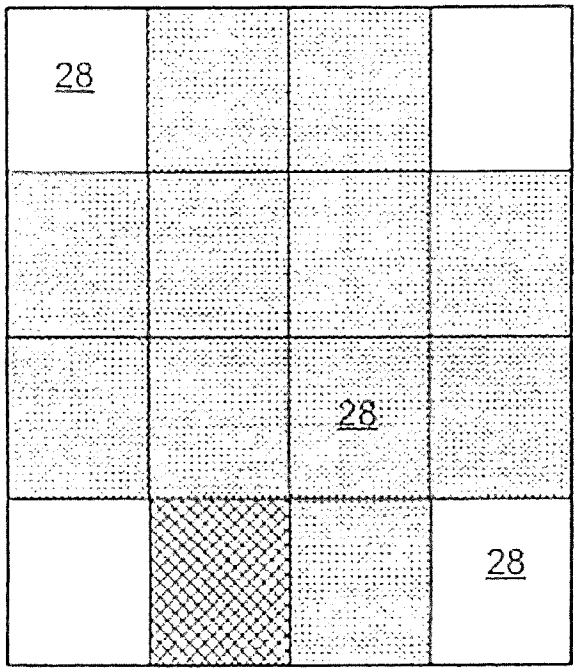
FIG. 4A Prior Art

FIG. 3B illustrates how the circular arrangement with the invention opens the central space inside the wellbay in comparison with the traditional arrangement of FIG. 3A. In FIG. 3B each riser 26 extends through the space 15 between the deck 10 and the centerwell known as a riser slot 28 best seen in FIG. 4B FIG. 4A is a plan view that illustrates the traditional spar wellbay arrangement of riser slots 28 in comparison with that of FIG. 4B, the circular wellbay when used with the inventive arrangement. For clarification, the different texturing shown in the slots 28 in FIG. 4 do not necessarily indicate a difference in the physical structure of the slots. The purpose is simply to show that one slot may be used for drilling risers and equipment while other slots are used for production risers and equipment. The water depths offshore, combined with the flexibility of drilling and production risers over such distances between the floating structure and sea floor, allow movement of the drilling and production risers to have a certain range of movement between different well locations at the sea floor.

Figure 5A:
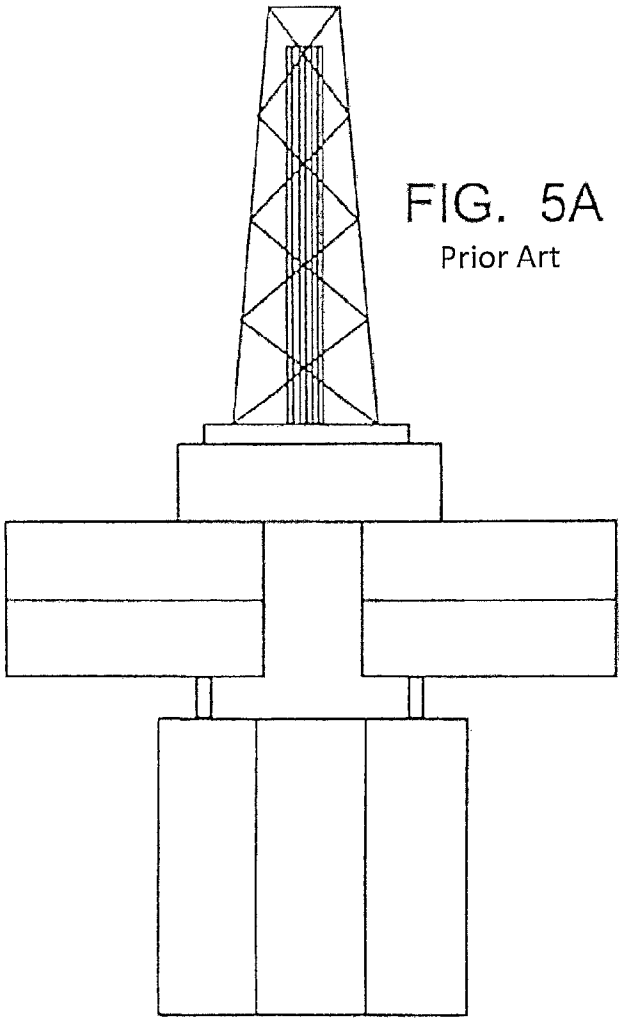
FIG. 5A Prior Art

FIG. 5A illustrates the traditional arrangement in comparison with the invention as shown in FIG. 5B which shows how equipment previously above upper deck level can be reduced by use of the inventive concept.

Figure 6A:
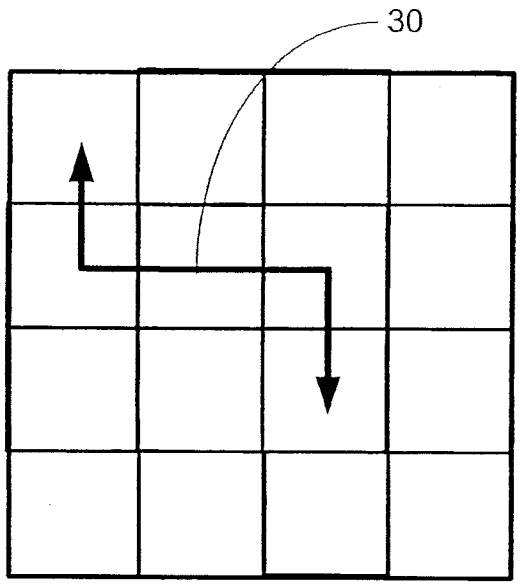
FIG. 6A Prior Art

FIG. 6A illustrates the more complicated skidding pattern 30 of the traditional arrangement in comparison with the skidding pattern of the inventive concept of the invention in FIG. 6B when used in a circular arrangement.

Figure 7B:
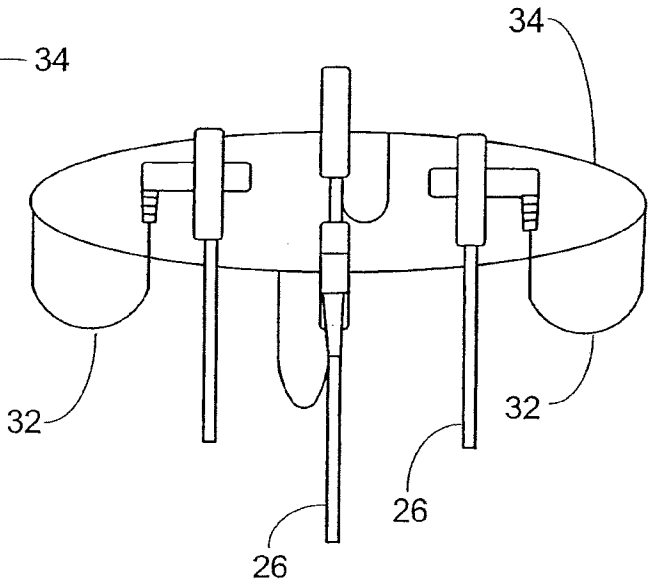
FIG. 7 illustrates a comparison of the flexible jumper arrangement in the traditional spar wellbay arrangement with that of the invention.
Figure 7A:
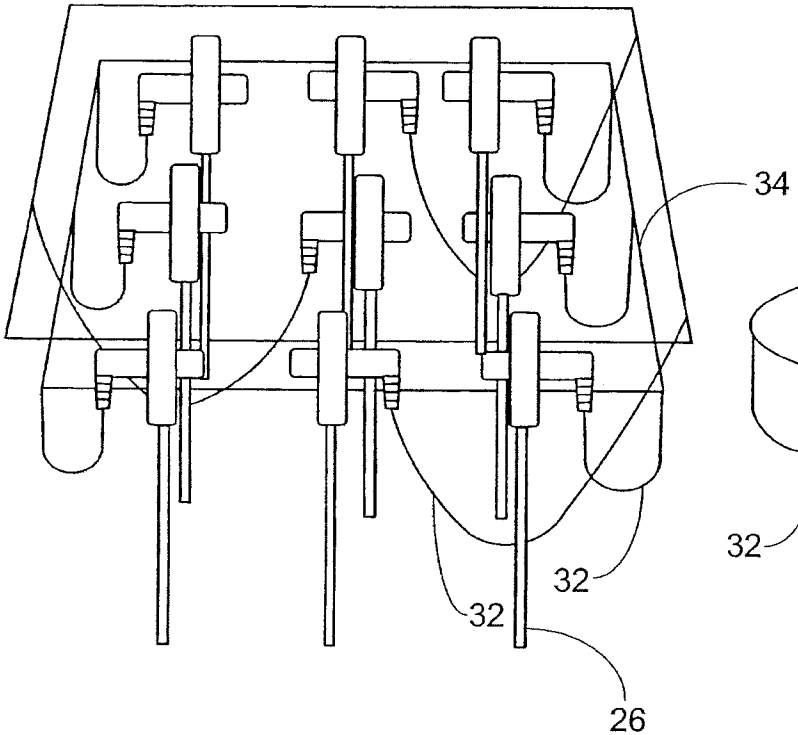
FIG. 7A Prior Art

FIG. 7A illustrates the flexible jumper arrangement of the traditional arrangement in comparison with the inventive concept of FIG. 7B when used in a circular arrangement. FIG. 7B illustrates that the flexible jumpers 32 do not cross other risers 26 in the routing to the manifold 34.

The invention provides several advantages over the known art.

The invention facilitates significant improvements in the wellbay design, allowing for the design and installation of more efficient drilling equipment and drilling operations. The invention also improves manifold connections of top tensioned risers to process equipment by directing connections away from the wellbay and avoiding interference of connection jumpers among other top tensioned risers in the wellbay. The concept opens the space beneath the waterline in the spar centerwell where additional buoyancy devices can be installed.

The inventive concept accommodates the configuration of drilling equipment by opening the space in the wellbay inside the topsides and hull and sheltering the drilling equipment and thus reducing the wind load area. Reducing the wind load area reduces the overturning moment and the requirement for heavy ballast in the keel. Being able to place the drilling equipment at a lower elevation in the wellbay improves drilling operations and efficiencies, improves safety in operations, and reduces the overall weight of the drilling equipment and spar hull.

The inventive concept allows the flexible jumpers to extend outward from their riser slots so as not to interfere with other jumpers.

The inventive concept allows the space below the waterline inside the hard tank centerwell to be used for additional buoyancy devices 17 to add to the spar hull total buoyancy.

The inventive concept opens space in the wellbay for placement and storage of equipment. Wind load area is significantly reduced with the capability to place equipment in the wellbay below the surface of the upper topsides deck. Reduction in wind load area may allow reduction in the size of the spar structure.

The inventive concept also lowers the global center of gravity of the spar. This has the potential to allow reduction of the spar size while still supporting an equivalent payload.

The inventive concept eliminates the requirement for a large skidding support structure on the upper deck of the topsides.

The inventive concept allows multiple well operations, such as work-overs, and eliminates the requirement to suspend drilling for such an operation.

Because equipment such as risers may be stored in the sheltered wellbay area, they may remain in the vertical racked position during a storm and eliminate the time normally spent to lay down the risers and equipment before personnel leave the structure.

While specific embodiments and/or details of the invention have been shown and described above to illustrate the application of the principles of the invention, it is understood that this invention may be embodied as more fully described in the claims, or as otherwise known by those skilled in the art (including any and all equivalents), without departing from such principles.

What is claimed as invention is:

1. A method of accessing each of a plurality of well slots comprising the steps of:

providing a spar hull having a centerwell open at an uppermost level and a lowermost level of the spar hull;

providing a deck in the centerwell positioned below the uppermost level of the spar hull and attached to the spar hull by shear plates;

providing a space between the deck and spar hull to receive equipment along the centerwell;

providing a topsides deck supported by the spar hull and having a wellbay opening therethrough that is coaxial with the centerwell;

providing access from the topsides deck to the space between the deck and the spar hull at each of the plurality of well slot;

positioning a drilling rig on the topsides deck above one of the plurality of well slots; and skidding the drilling rig along the topside deck around the periphery of the wellbay opening in a circular pattern to a position above another of the plurality of well slots, and accessing the another of the plurality of well slots with the drilling rig.

2. The method of claim 1, wherein the centerwell has a circular periphery, and the skidding of the drilling rig is in a circular skidding pattern.

3. The method of claim 1, further comprising performing a first operation requiring access to the one of the plurality of well slots concurrently with a second operation requiring access to the another of the plurality of well slots.

4. The method of claim 1, wherein the first well operation is selected from the group consisting of drilling, work over and production.

5. The method of claim 1, wherein the recessed deck is defined by a plate that is attached to the spar hull and positioned below the uppermost level of the spar hull.

6. The method of claim 1, further comprising positioning a buoyancy device in the centerwell of the spar hull, wherein the buoyancy device has enclosed upper and lower ends, and wherein the deck is defined by the enclosed upper end.

7. The method of claim 6, wherein the buoyancy device is positioned in the centerwell so that the deck is below the uppermost level of the spar hull.

8. A method of configuring and accessing riser slots for offshore oil and natural gas exploration comprising;

providing a spar hull having a centerwell open at an uppermost level and a lowermost level of the spar hull;

positioning a deck in the centerwell below the uppermost level of the spar hull to define a space between the deck and the spar hull;

dividing the space between the deck and the spar hull into a plurality of adjacent riser slots;

connecting the deck and the spar hull with shear plates, wherein the shear plates define a boundary between adjacent riser slots;

positioning equipment on a topsides deck supported by the spar hull, wherein the topsides deck having a well bay opening coaxial with the centerwell; and, skidding the equipment along the periphery of the well bay opening to access one of the riser slots.

9. The method of claim 8, further comprising storing a plurality of risers vertically oriented within the centerwell above the deck and below the topsides deck.

10. The method of claim 9, further comprising installing the plurality of risers from sea floor through one of the riser slots to a manifold above the top portion of the spar hull.

11. The method of claim 8, wherein the centerwell has a circular periphery.

12. The method of claim 11, wherein the topsides deck is configured for skidding of equipment in a circular pattern.

13. The method of claim 10, wherein the step of installing the plurality of risers further comprising installing the risers in a radial pattern.

14. A floating spar hull arrangement for offshore hydrocarbon exploration and production, the floating spar hull arrangement comprising:

a topsides deck;

a spar hull supporting the topsides deck, the spar hull having an inner wall defining a centerwell extending through an uppermost level and a lowermost level of the spar hull, the topsides deck having an opening therethrough to provide access to the centerwell;

a recessed deck positioned below the topsides deck and a space is defined between the inner wall of the spar hull and an outer periphery of the recessed deck;

a plurality of shear plates connecting the recessed deck to the spar hull and dividing the space into a plurality of riser slots; each riser slot defined by two shear plates, the inner wall of the spar hull and the outer periphery of the recessed deck; and, a plurality of risers, each riser positioned within a respective one of the plurality of riser slots and extending between the sea floor and the one or more risers.

15. The spar hull arrangement of claim 14, wherein the recessed deck is defined by a plate that is attached to the spar hull.

16. The spar hull arrangement of claim 15, wherein the plate is positioned below the uppermost level of the spar hull.

17. The spar hull arrangement of claim 14, further comprising a buoyancy device positioned in the centerwell and attached to the spar hull, wherein the buoyancy device has enclosed upper and lower ends, and wherein the recessed deck is defined by the enclosed upper end.

18. The spar hull arrangement of claim 17, wherein the buoyancy device is positioned in the centerwell so that the recessed deck is below the uppermost level of the spar hull.

19. The spar hull arrangement of claim 14, wherein the centerwell has a circular periphery, and the topsides deck is configured to provides for movement of equipment in a circular pattern.

20. The spar hull arrangement of claim 19, wherein the periphery of the wellbay opening is circular.

* * * * *